United States Patent [19]

Robinson

[11] 4,335,560

[45] Jun. 22, 1982

[54] METHOD FOR CONTAINERIZING ASPHALT

[75] Inventor: J. Ronald Robinson, Mesa, Ariz.

[73] Assignee: Crafco, Inc., Phoenix, Ariz.

[21] Appl. No.: 144,301

[22] Filed: Apr. 28, 1980

[51] Int. Cl.[3] ..... B65B 63/08; B65B 3/04; B65B 35/50

[52] U.S. Cl. ..... 53/440; 53/447; 53/467

[58] Field of Search ..... 53/448, 447, 453, 458, 53/459, 468, 469, 473, 449, 440

[56] References Cited

U.S. PATENT DOCUMENTS

| | | | |
|---|---|---|---|
| 2,127,401 | 8/1938 | Gillican | 53/46 9 X |
| 2,159,835 | 5/1939 | Waters | 53/469 X |
| 2,364,012 | 11/1944 | Walton et al. | 53/449 X |
| 3,450,253 | 6/1969 | Nielsen | 53/449 X |
| 3,487,918 | 1/1970 | Roden et al. | 53/447 X |
| 3,491,505 | 1/1970 | Hasselmann | 53/448 |
| 3,777,445 | 12/1973 | Anderson | 53/447 X |
| 3,881,295 | 5/1975 | Derby | 53/449 X |

*Primary Examiner*—Horace M. Culver
*Attorney, Agent, or Firm*—Herbert E. Haynes, Jr.

[57] ABSTRACT

The present invention discloses a method for containerizing asphalt in a plurality of manually handleable packages.

5 Claims, 11 Drawing Figures

METHOD FOR CONTAINERIZING ASPHALT

BACKGROUND OF THE INVENTION

1. Field of the Invention

This invention relates to the handling of asphalt and more particularly to a method for placing molten asphalt in manually handleable packages for shipping to a job site.

2. Description of the Prior Art

As is well known in the art, molten asphalt is employed for various jobs in the construction industry such as for seal coating roadways, runways, and other comparatively large tasks. Molten asphalt is also used for comparatively smaller jobs such as filling cracks and expansion joints in paved surfaces, coating and/or patching roofs, and various other spot repair applications.

In the comparatively large jobs, such as the seal coating of a paved surface, where large quantities of the molten asphalt are to be used, the molten asphalt is placed in special transport trucks at the asphalt plant and delivered directly to the job site where it is transferred into heated spray applicator trunks. In some instances, the molten asphalt is mixed at the job site with special additives, such as shredded rubber, prior to being applied to the paved surface. At any rate, such a procedure must be accomplished rather rapidly to prevent cooling of the molten asphalt and to prevent unnecessary delays in equipment and manpower time. Even when this procedure is most efficiently accomplished, it is an expensive matter and utilizing such a procedure cannot be economically justified in the comparatively smaller jobs such as the hereinbefore mentioned filling of cracks and joints in paved surfaces.

Therefore, it is a common practice to place molten asphalt in manually handleable containers at a manufacturing facility and shipping the desired number of such containers when and as needed to the relatively small job sites. When the asphalt is needed at such a site, the containers are torn open and the asphalt which has since cooled and thus solidified is placed in the tank of a suitable heater/applicator mechanism, where it is heated to return it to its molten state, mixed with the additives, if desired, and utilized to accomplish the desired task.

The commonly used, and to the best of my knowledge, the only method used for placing the asphalt in manually handleable containers is in the form of an elongated conveyor system. At a first station of the prior art conveyor system, a plastic package or liner is inserted into an open corrugated cardboard box and transported by the conveyor to a second station below the outlet of a stationary molten asphalt dispensing unit. At this second station, the dispensing mechanism deposits a predetermined amount of the molten asphalt, usually about 60 pounds, in each container which is passed thereunder. After such filling, the containers are transported to a third station on the conveyor system where the asphalt filled packages and their container boxes are closed, and from there they are transported to the last station where they are manually off-loaded from the conveyor system and placed on pallets for subsequent shipping.

The prior art method described above has several drawbacks. In the first place, the off-loading and stacking tasks must be accomplished without excessive delays so as not to halt production. Therefore, the asphalt in the containers is still in the molten state when the off-loading and pallet stacking operations need to be accomplished. The molten state of the asphalt rules out the use of all but the most sophisticated mechanized equipment, and the cost of such equipment cannot be justified in operations of this sort. Therefore, the asphalt containers are manually off-loaded and stacked on the pallet, and this is a very arduous and uncomfortable job due to the weight of the asphalt containers and the heat radiating therefrom.

The second, and most serious, problem with the prior art conveyor system for containerizing asphalt involves the lack of portability of the equipment. High shipping costs dictates that a prior art conveyor system cannot be economically used to containerize asphalt for use outside of a given area. Thus, a prior art conveyor system is intermittently used in that it is normally capable of satisfying the needs of its immediate area with, for example, two days of operation per week. Providing containerized asphalt for areas outside of the immediate vicinity of an existing prior art conveyor system involves either paying the high shipping costs, or building and manning other conveyor systems which will also be intermittently operated.

Therefore, a need exists for a new and improved method for containerizing asphalt which overcomes some of the problems and shortcomings of the prior art.

SUMMARY OF THE INVENTION

In accordance with the present invention, a new and improved method for containerizing asphalt in manually handleable packages is disclosed.

The method of the present invention includes the first step of preparing a plurality of manually handleable packages by supporting them in an upstanding open position within container means. In a first structure suitable for use in practicing the method of the present invention, the container means are in the form of corrugated cardboard boxes each of which is configured to support a single one of the manually handleable packages. In a second structure, the container means are in the form of corrugated cardboard boxes, each of which is configured to support a predetermined number of the handleable packages.

In any event, the next step of the method of the present invention is to arrange a predetermined number of the prepared packages on a pallet to form a first tier of said prepared packages thereon. It will be understood that very rarely, if ever, will the method of the present invention be practiced to fill packages which are so few in number as to allow a single pallet to support the entire number of packages that are to be filled with molten asphalt. Thus, in most, if not all situations a plurality of pallets are arranged in a substantially linearly aligned juxtaposed array, and each of the pallets have a first tier of prepared packages positioned thereon.

A molten asphalt dispensing vehicle means, having a movable dispenser line, is then moved in a path which is parallel to the aligned pallets, and at a speed which is slow enough to allow the dispenser hose to be moved from package to package so that molten asphalt is deposited in each of the prepared packages which form the first tier of packages carried on the pallets. A particular vehicle suitable for accomplishing this asphalt dispensing task is fully disclosed in U.S. Pat. No. 4,159,877, issued July 3, 1979, to C. C. Jacobson et al. It will be understood, however, that other known asphalt dispensing vehicles may also be used for this purpose.

The first tier of packages which are now filled with molten asphalt are then closed and then their container means are also closed.

The next step involves arrangement of another predetermined number of packages, which have been prepared as described above, on the pallets to form a second tier of packages atop the now closed container means in which the first tier of asphalt filled packages are supportingly contained. The molten asphalt dispenser vehicle means is again moved along the prescribed path and each of the prepared packages which form the second tier is filled and subsequently closed.

The above described steps may be repeated to provide a third tier of packages on each of the pallets, and repeated again to provide as many tiers as the pallets can reasonably support. When the desired number of tiers of handleable packages have been filled and the packages along with their container means have been closed, all that remains to be done is to band the pallets in the conventional manner for shipment, when needed, to a job site.

From the above, it will be noted that no manual handling of hot asphalt filled packages is required in the method of the present invention as was the case with the prior art. And, the only piece of specialized equipment needed to practice the instant method is the asphalt dispenser mechanism which can be in the form of an automotive vehicle, a trailer, or other highly portable mechanism.

Accordingly, it is an object of the present invention to provide a new and improved method for containerizing molten asphalt.

Another object of the present invention is to provide a new and improved method for containerizing molten asphalt which eliminates manual handling of the hot asphalt filled containers.

Another object of the present invention is to provide a new and improved method for containerizing molten asphalt, with the method employing a minimum amount of specialized equipment which is of a highly portable nature.

The foregoing and other objects of the present invention, as well as the invention itself, may be more fully understood from the following description when read in conjunction with the accompanying drawings.

DESCRIPTION OF THE PREFERRED EMBODIMENT

Figure 1:
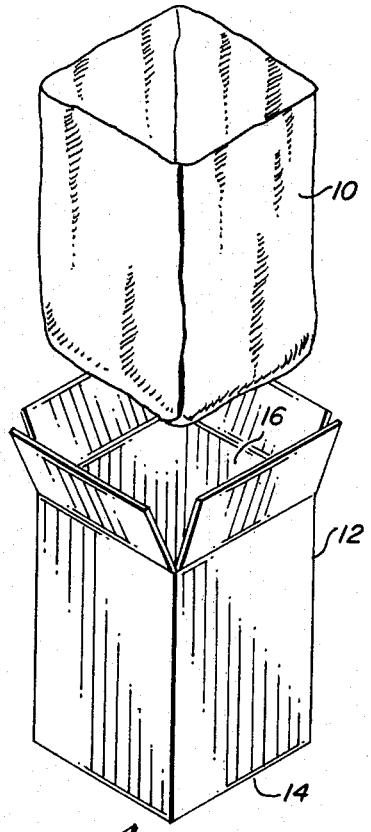
FIG. 1 is a perspective view of a typical manually handleable package in exploded relationship to a container means in which the package is to be prepared for receiving molten asphalt in accordance with the method of the present invention.

Referring more particularly to the drawings, FIG. 1 shows a package 10 which is sized and otherwise designed to receive and contain a quantity of asphalt in an amount which may be manually handled. Since asphalt is a solid at normal ambient temperatures, it must be in the molten state during containerization thereof in accordance with the method of the present invention, as will hereinafter be described in detail. Therefore, the package 10 must be capable of withstanding the elevated temperatures of molten asphalt, and a thin-wall plastic material, of about two or three mils thick, is customarily used for this purpose.

Figure 2:
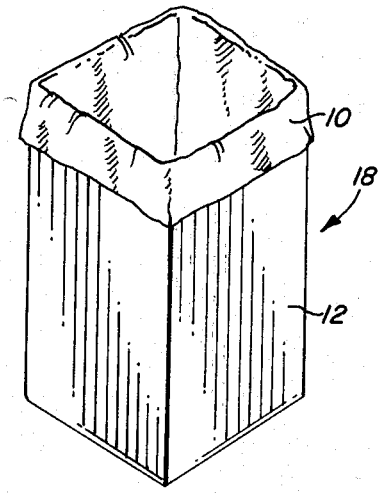
FIG. 2 is a perspective view illustrating the typical manually handleable package as having been inserted in the container means to complete the first step of the method of the present invention.

Such thin-wall packages must be prepared for receiving the molten asphalt, and this is accomplished by inserting the package 10 in a container means 12 so that the package 10 is supported in an upstanding open position, with such preparation being shown in FIGS. 1 and 2.

The container means 12 is preferably in the form of the corrugated cardboard carton shown which, as is customary, is received from the manufacturer of such products in a flat, collapsed state (not shown). The carton 12 is prepared for use by expanding it and closing its bottom 14, such as with staples (not shown), in the well known manner which leaves its top 16 open.

The package 10 is prepared for use by inserting it into the container means 12, as shown and described above, and a plurality of the packages 10 are prepared for use in that manner, and such prepared packages will hereinafter be identified by the reference numeral 18.

Figure 3:
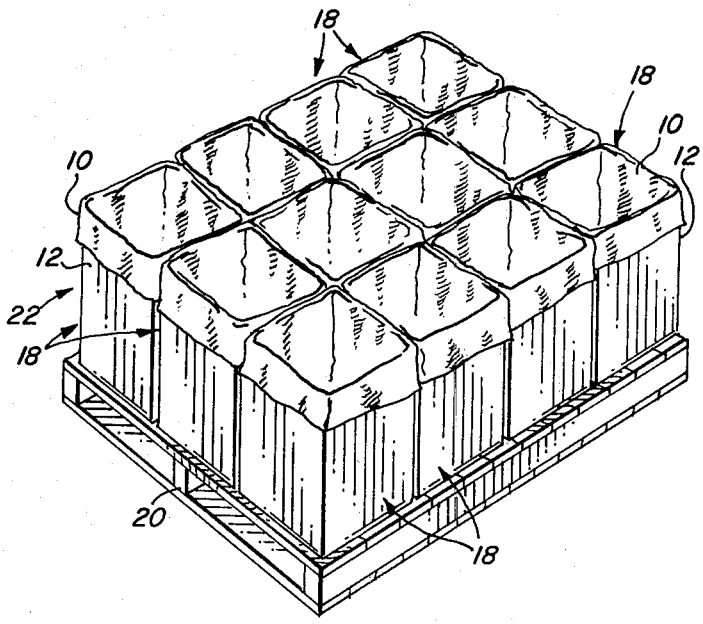
FIG. 3 is a perspective view of a pallet upon which a predetermined number of the prepared manually handleable packages have been arranged to form a first tier of such packages on the pallet.

A predetermined number of the prepared packages 18, are then arranged on a pallet 20 so that their respective container means 12 are in contiguous engagement with each other as shown in FIG. 3. The exact number of prepared packages 18 arranged on the pallet 20 is, of course, determined by the size of the packages themselves and the pallet on which they are arranged. In actual practice, a conventionally sized pallet measuring about $3\frac{1}{2}' \times 3\frac{1}{2}'$, will support twelve of the prepared packages 18 which are appropriately sized to contain about 60 pounds of asphalt. In any event, the predetermined number of prepared packages 18 arranged as shown in FIG. 3, provides the pallet with a first tier 22 of the prepared packages 18.

In most circumstances, if not all, the number of prepared packages which are to be filled with asphalt in accordance with the present method will far exceed the number which can be supported on a single pallet. Therefore, a plurality of pallets 20 are provided with a first tier 22 of prepared packages 18, and the pallets are arranged in a linearly aligned juxtaposed relationship as shown in FIG. 4.

Figure 4:
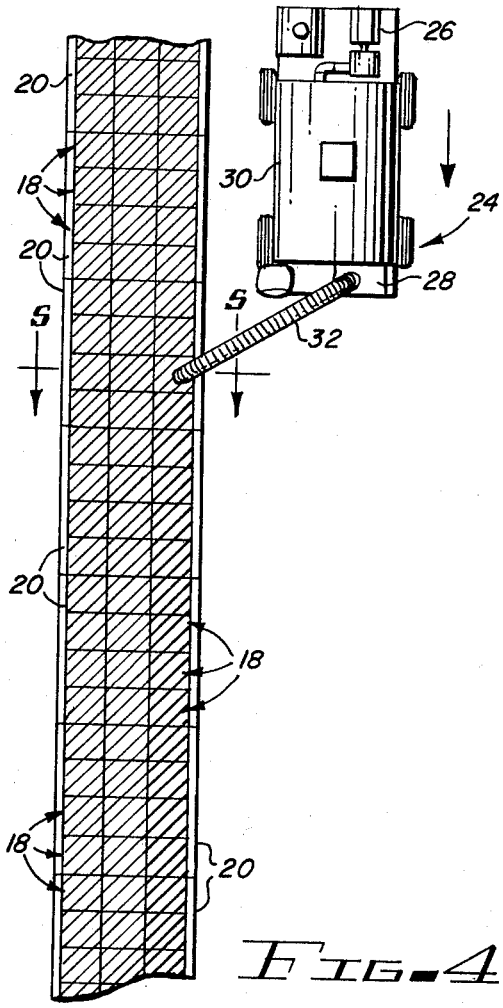
FIG. 4 is a plan view of a plurality of pallets each supporting a first tier of the prepared packages, with the pallets arranged in juxtaposed linear alignment with respect to each other, and also showing a movable molten asphalt dispenser vehicle means in its working position relative to the aligned pallets.

A movable molten asphalt dispenser vehicle means 24, as shown in FIG. 4, is then moved in a linear path which is parallel and adjacent the linearly aligned pallets 20 for the purpose of dispensing molten asphalt into the prepared packages 18 which form the first tier of packages 22 on each of the pallets 20. The molten asphalt dispenser vehicle means 24 may be of any suitable configuration such as a tank truck, trailer vehicle, or any other movable vehicle which is especially equipped to handle and dispense the molten asphalt. As shown in FIG. 4, the vehicle means 24 is preferably a self-propelled vehicle having an engine 26 which propels the vehicle and also drives a suitable pump 28 which delivers the molten asphalt from a tank 30 through a movable dispenser line 32 which may be in the form of a flexible hose.

Figure 5:
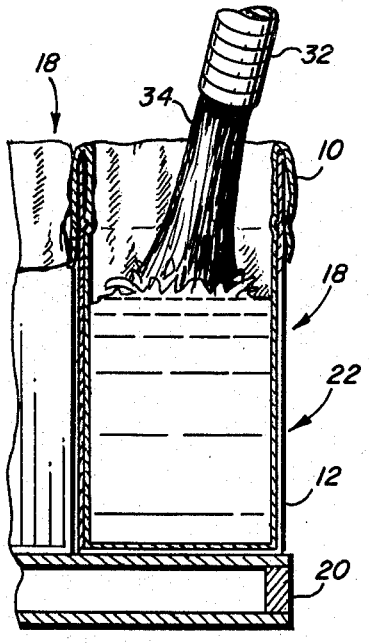
FIG. 5 is an enlarged fragmentary sectional view taken along the line 5—5 of FIG. 4 to show the dispensing of molten asphalt into one of the prepared packages.

The molten asphalt dispenser vehicle means 24 is moved along the above described path at a speed which is suitable to permit the delivery line 32 to be positioned in turn over each of the prepared packages 18 which form the first tier 22 of packages on the plurality of pallets 20. Thus, in the manner shown in FIG. 5, each of the prepared packages 18 is filled to a predetermined level with the molten asphalt 34.

Figure 6:
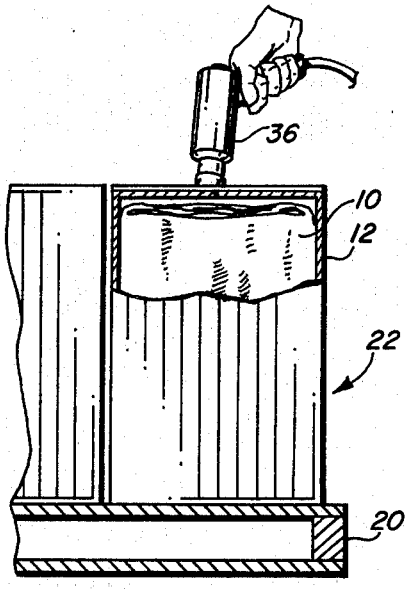
FIG. 6 is a view similar to FIG. 5 and showing the closing of an asphalt filled package and its container means.

After the prepared packages 18 which form the first tier 22 are filled in the manner shown and described, the filled packages 10 are foldingly closed and their respective container means 12 are also closed by folding the flaps thereof in the normal manner and fixing them in that closed position such as by utilization of a staple gun 36 shown in FIG. 6.

Figure 7:
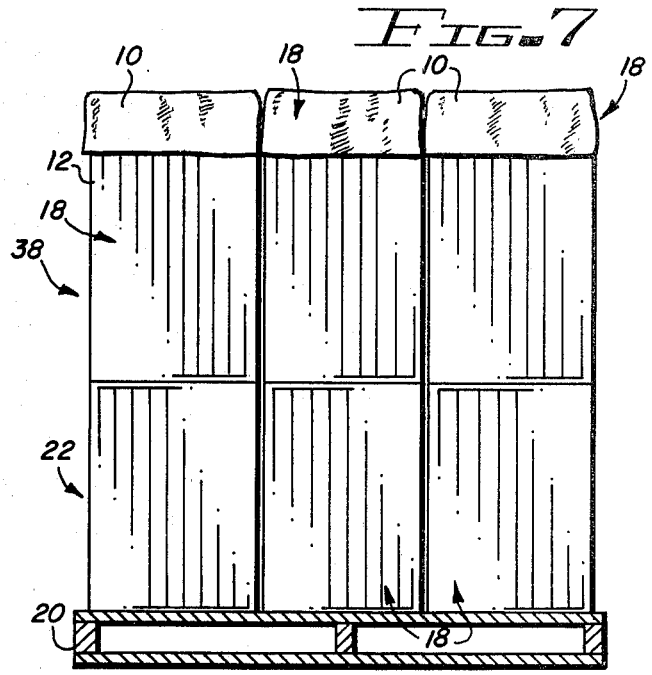
FIG. 7 is an elevational view of a typical pallet having the first tier of asphalt filled packages and their container means closed, and having a second tier of prepared packages and their container means arranged thereon and ready for filling and subsequent closing.

When the prepared packages 18 which form the first tiers 22 on the pallets 20 have been filled with molten asphalt and closed in the above described manner, a second predetermined number of the prepared packages 18 are arranged on the pallets 20, in the manner shown in FIG. 7, to form second tiers 38 on each of the pallets 20 with the second tiers being stackingly positioned atop the first tiers 22 thereof.

The molten asphalt dispenser vehicle means 24 is then moved once again along the described path and each of the prepared packages 18 which form the second tiers 38 of packages is filled with molten asphalt 34 and subsequently closed in the manner hereinbefore described.

Figure 8:
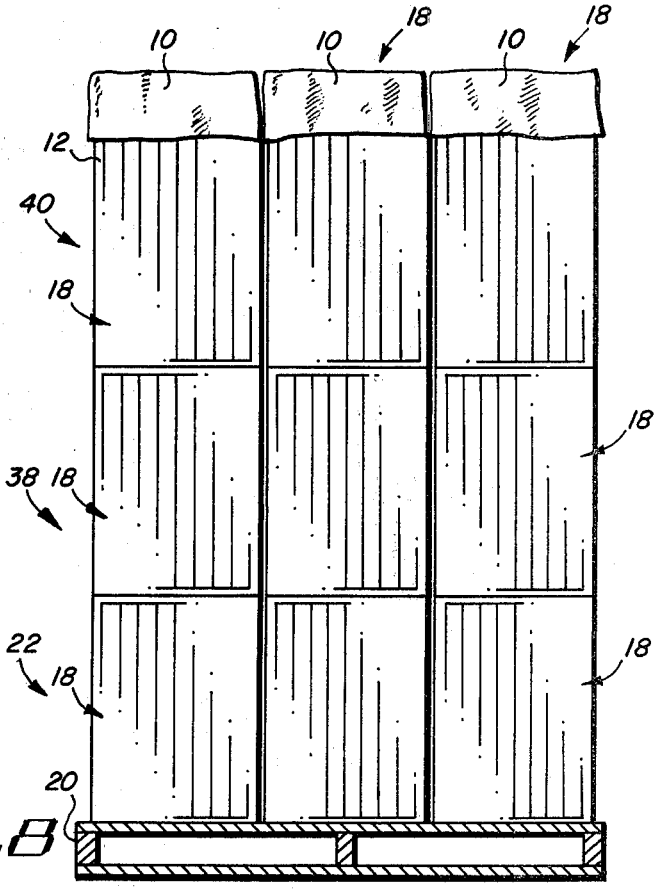
FIG. 8 is a view similar to FIG. 7 and showing the first and the second tiers of asphalt filled packages, and their container means, as having been closed with a third tier of packages and container means ready for filling and subsequent closing.

The above described steps, which comprise the method of the present invention, may be repeated until a desired number of tiers have been stackingly arranged on the pallets 20, and have been filled and closed. In actual practice, the above steps are repeated to provide a third tier 40 of the prepared packages 18, as shown in FIG. 8. For subsequent ease of handling, such as with a conventional fork-lift truck (not shown) the number of tiers are normally limited to the three shown.

After considering the above disclosed steps of the method of the present invention, it will be obvious that several modifications may be made in the structures, arrangements and the like which are utilized in the practice of the invention. For example, the molten asphalt dispenser vehicle means 24 may be in any suitable configuration as hereinbefore discussed. Further, the linearly aligned juxtaposed positioning of the plural pallets 20, while having been found to be the most practical arrangement, the method of the present invention should not be limited to this exact arrangement in that nonlinear positioning of the plural pallets will work.

The method of the present invention can also be utilized for containerizing asphalt in the manually handleable packages 10 which have been prepared for use in a manner which differs from that hereinbefore fully disclosed.

Figure 9:
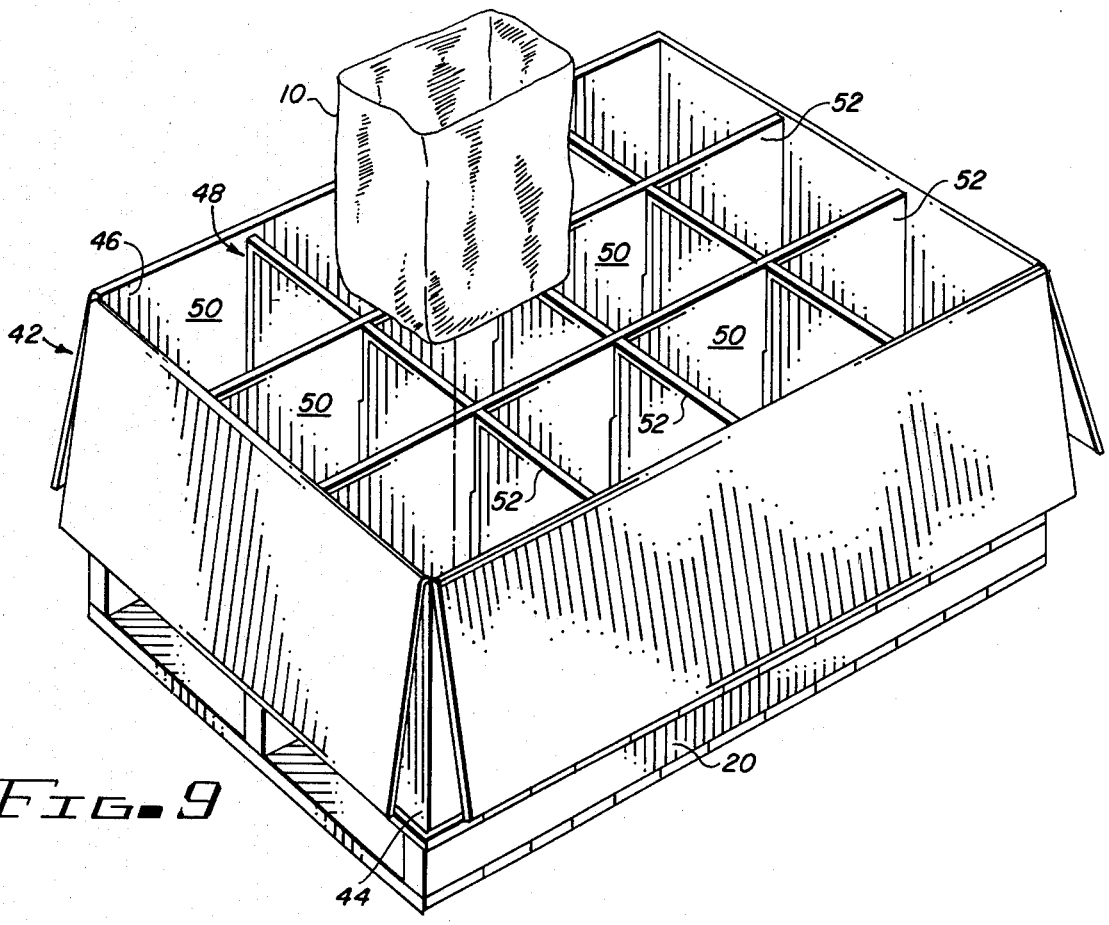
FIG. 9 is a perspective view of a typical manually handleable package shown in exploded relationship with respect to a modified container means suitable for use in the method of the present invention.

A modified way of preparing the packages 10 for use is shown in FIG. 9 wherein a predetermined number of the manually handleable packages 10 are prepared for use in a multicompartment container means 42. The container means 42 is in the form of a comparatively large carton preferably of corrugated cardboard which is received in the flat, collapsed state as is customary in the art. The container means 42 is expanded in the known manner and its bottom 44 is closed, such as with staples (not shown) and its top 46 is left open. A partition 48 is then placed within the container means 42, with the partition also being preferably formed of corrugated cardboard, and of a configuration sometimes referred to as an egg case or egg crate divider. The partition 48 is employed to divide the interior of the container means 42 into a plurality of individual compartments 50, and such dividing is accomplished by providing the partition with suitably notched divider walls 52 which are assembled in the well known manner to provide the desired configuration.

The manually handleable packages 10 are prepared for use by inserting a different one of the packages 10 into each of the compartments 50 of the container means 42 so that the manually handleable packages 10 are supported therein in upstanding open positions.

As seen in FIG. 9, the container means 42 is shown as being provided with 12 of the compartments 50, and it will be noted that this number is equal to the number needed to provide each of the tiers 22, 38 and 40 as hereinbefore described. Thus, placing a single one of the container means 42 on the pallet 20 as shown in FIG. 9, and preparing the packages 10 for use by inserting them into the container means will provide a first tier 54 of prepared packages on the pallet 20. In accordance with the steps hereinbefore described in detail, the prepared packages 10 of the first tiers 54 of the aligned pallets 20 are filled with molten asphalt and subsequently closed, and the container means 42 is thereafter closed in a manner similar to that hereinbefore described in relationship to the container means 12.

Figure 10:
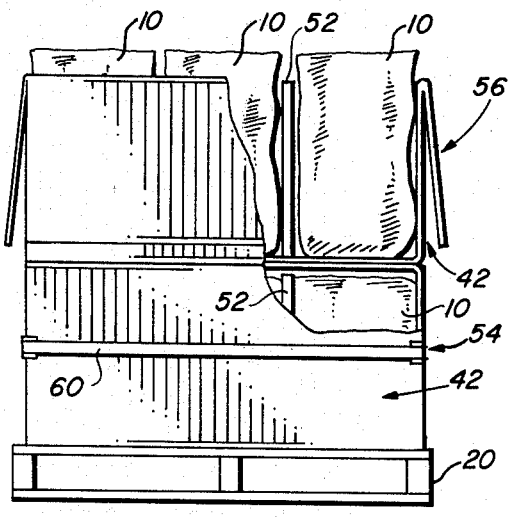
FIG. 10 is an elevational view, partially broken away to illustrate the structure of FIG. 9 and its use in the method of the present invention.

When filling and closing of the first tier 54 is completed as shown in FIG. 10, a second tier 56, comprising a predetermined number of the packages 10 prepared for use in another one of the container means 42, is stackingly positioned atop the first tier 54. Then the second tier 56 may be filled with molten asphalt and subsequently closed as described above.

Figure 11:
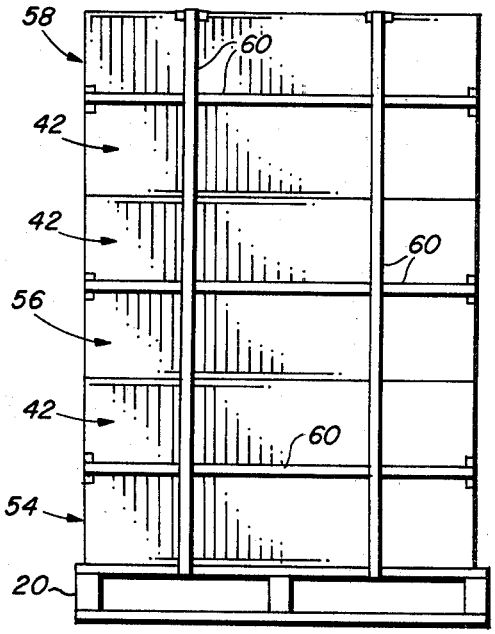
FIG. 11 is an elevational view illustrating the steps of the method of the present invention as having been accomplished on a plurality of the modified structures shown in FIG. 9.

The steps of the method of the present invention may be repeated to provide a third tier 58 as shown in FIG. 11, with further tiers being formed on the pallets 20 in the same manner if desired.

When the desired number of tiers have been arranged on the pallets 20, all that remains to be done is to band the pallets 20 as shown at 60, in the well known manner, and they are then ready for shipment to the job site.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles.

For example, the container means 12 is shown and described as providing support for a single manually handleable package 10, and the container means 42 is shown and described as providing support for a full tier of the packages 10. It is obvious that other container means (not shown) could be used with such containers providing support for more than one package but less than a full tier.

The appended claims are therefore intended to cover and embrace any such modifications within the limits only of the true spirit and scope of the invention.

What I claim is:

1. A method for containerizing asphalt in a plurality of manually handleable packages comprising the steps of:

(a) preparing a plurality of manually handleable packages in the form of open top bags of thin-wall plastic material for receiving molten asphalt by supporting each of said packages in an upstanding open position within a different cardboard box of the type having closable top flaps;

(b) arranging a predetermined number of said prepared packages on a stationary pallet to provide said pallet with a first tier of said prepared packages;

(c) moving a molten asphalt dispenser vehicle means to a position adjacent said pallet;

(d) depositing a predetermined amount of molten asphalt from said molten asphalt dispensing vehicle means into each of said prepared packages which form said first tier;

(e) closing each of said prepared packages which forms said first tier subsequent to deposition of the molten asphalt therein but prior to the cooling thereof by foldingly closing the open top bags of thin-wall plastic material;

(f) closing said closable flaps of said cardboard boxes to complete containerization of the molten asphalt in said packages of said first tier; and (g) repeating steps b, c, d, e, and f sequentially to provide a second tier of closed asphalt filled manually handleable packages with said second tier being stackingly arranged atop said first tier with this repeating step being accomplished prior to cooling of the molten asphalt containerized in said packages of said first tier.

2. The method of claim 1 comprising the further steps of again repeating steps b, c, d, e and f sequentially to provide a third tier of closed asphalt filled manually handleable packages, with said third tier being stackingly disposed atop said second tier.

3. The method of claim 1 comprising the further steps of sequentially repeating steps b, c, d, e and f to provide a desired number of tiers of closed asphalt filled manually handleable packages with said desired number of tiers being stackingly disposed atop said first tier.

4. A method for containerizing asphalt in a plurality of manually handleable packages comprising the steps of:

(a) preparing a plurality of manually handleable packages in the form of open top bags of thin-wall plastic material for receiving molten asphalt by supporting each of said packages in an upstanding open position within a cardboard box of the type having closable top flaps;

(b) placing a plurality of pallets in stationary substantially aligned juxtaposed positions with respect to each other;

(c) arranging a predetermined number of said prepared packages on each of said pallets to provide each of said pallets with a first tier of said prepared packages;

(d) moving a molten asphalt dispenser vehicle means in a path adjacent said aligned pallets;

(e) dispensing a predetermined amount of molten asphalt from said molten asphalt dispenser vehicle means into each of said prepared packages which form said first tiers as said molten asphalt dispenser vehicle is moved in a path adjacent said plurality of pallets;

(f) closing each of said prepared packages which form said first tiers subsequent to the dispensing of molten asphalt therein but prior to the cooling thereof by foldingly closing the open top bags of thin-wall plastic material;

(g) closing said closable flaps of said cardboard boxes in which said packages which form said first tiers are prepared to complete containerization of the molten asphalt in said prepared packages of said first tiers; and (h) repeating steps b, c, d, e, f, and g prior to cooling of the molten asphalt containerized in said packages of said first tiers to provide a second tier of closed asphalt filled manually handleable packages on each of said pallets with said second tiers being stackingly arranged atop said first tiers.

5. The method of claim 4 and including the further steps of sequentially repeating steps c, d, e, f, and g prior to the cooling of the molten asphalt containerized in said packages of said second tiers to provide a third tier of closed asphalt filled manually handleable container packages on each of said pallets with said third tiers being stackingly disposed atop said second tiers.

* * * * *